US009173461B2

(12) United States Patent
Yang

(10) Patent No.: US 9,173,461 B2
(45) Date of Patent: Nov. 3, 2015

(54) UMBRELLA COVER AND BEACH UMBRELLA

(71) Applicant: ZHEJIANG HENGFENG TOP LEISURE CO., LTD., Zhejiang (CN)

(72) Inventor: Baoqing Yang, Zhejiang (CN)

(73) Assignee: ZHEJIANG HENGFENG TOP LEISURE CO., LTD. (CN)

( * ) Notice: Subject to any disclaimer, the term of this patent is extended or adjusted under 35 U.S.C. 154(b) by 0 days.

(21) Appl. No.: 14/242,052

(22) Filed: Apr. 1, 2014

(65) Prior Publication Data

US 2014/0326284 A1 Nov. 6, 2014

(30) Foreign Application Priority Data

May 2, 2013 (CN) ..... 2013 1 0162357

(51) Int. Cl.
*A45B 25/22* (2006.01)
*A45B 25/20* (2006.01)
*A45B 25/18* (2006.01)

(52) U.S. Cl.
CPC ..... *A45B 25/20* (2013.01); *A45B 25/22* (2013.01); *A45B 2025/186* (2013.01); *A45B 2200/1036* (2013.01)

(58) Field of Classification Search
CPC ..... A45B 25/18; A45B 25/20; A45B 25/22; A45B 2025/186; A45B 2200/1036; E04H 15/28; E04H 15/16; E04H 15/14; E04H 15/10
USPC ..... 135/33.2, 33.36, 33.7, 33.71, 93–94, 98
See application file for complete search history.

(56) References Cited

U.S. PATENT DOCUMENTS

| | | | | |
|---|---|---|---|---|
| 162,570 | A * | 4/1875 | Mitchell | 135/33.7 |
| 2,841,160 | A * | 7/1958 | Dewispelere | 135/33.71 |
| 3,032,047 | A * | 5/1962 | Wendorf | 135/33.7 |
| 3,456,661 | A * | 7/1969 | Farley | 135/33.7 |

(Continued)

FOREIGN PATENT DOCUMENTS

| | | | |
|---|---|---|---|
| CN | 1264560 | A | 8/2000 |
| CN | 102987673 | A | 3/2013 |

(Continued)

OTHER PUBLICATIONS

First Office Action regarding the Chinese priority patent Application No. 201310162357.5; Date of Issue: Jun. 3, 2015, with English summary.

*Primary Examiner* — Winnie Yip
(74) *Attorney, Agent, or Firm* — Cantor Coburn LLP

(57) ABSTRACT

An umbrella cover includes: a main umbrella cove provided with a vent; and a shading portion arranged at the vent and adapted to shade sunshine from the vent. When wind blows toward the umbrella cover, a part of the wind may blow through the vent and take away hot inside the umbrella, thus achieving the ventilation of the umbrella. In addition, since the main umbrella cover is provided with the vent, the area of the umbrella cover subjected to the wind force is reduced and the wind force subjected by the umbrella cover is reduced further, thus improving the stability of the umbrella, and thereby decreasing the risk of the umbrella blown down by the wind. Furthermore, since the umbrella cover is the umbrella cover of one layer constituted by the main umbrella cover and the shading portions, the hot inside the umbrella is easy to be dissipated.

12 Claims, 2 Drawing Sheets

(56) References Cited

U.S. PATENT DOCUMENTS

| | | | | |
|---|---|---|---|---|
| 5,368,055 | A * | 11/1994 | Johnson et al. | 135/33.7 |
| 6,095,171 | A * | 8/2000 | Lin et al. | 135/33.7 |
| 6,401,737 | B1 * | 6/2002 | Kloor, III | 135/33.7 |
| 7,806,131 | B1 * | 10/2010 | Seiler | 135/33.2 |
| 2002/0189656 | A1 * | 12/2002 | David | 135/33.7 |
| 2005/0005958 | A1 * | 1/2005 | Connelly | 135/33.41 |
| 2006/0289045 | A1 * | 12/2006 | Amador | 135/16 |
| 2008/0041433 | A1 * | 2/2008 | Caldwell | 135/97 |
| 2009/0235965 | A1 * | 9/2009 | Kupferman | 135/33.7 |
| 2010/0258151 | A1 | 10/2010 | Vogt | |

FOREIGN PATENT DOCUMENTS

| | | | |
|---|---|---|---|
| FR | 2731328 | A1 | 9/1996 |
| JP | H11332624 | A | 12/1999 |

* cited by examiner

UMBRELLA COVER AND BEACH UMBRELLA

This application claims the priority to Chinese Patent Application No. 201310162357.5, entitled "UMBRELLA COVER AND BEACH UMBRELLA", filed with the Chinese Patent Office on May 2, 2013, which is incorporated by reference in its entirety herein.

FIELD

The disclosure relates to the technical field of outdoor leisure production, and more particularly to an umbrella cover. The disclosure also relates to a beach umbrella with the umbrella cover.

BACKGROUND

Many people favor beach relaxing. However, due to heat and sunshine at the beach, a beach umbrella is usually applied for shading the sunshine, thus providing a cool place to rest and reducing ultraviolet radiation.

The beach umbrella includes: an umbrella pole; an umbrella cover arranged at a top end of the umbrella pole and adapted to shade sunshine; and an umbrella seat arranged at a bottom end of the umbrella pole and adapted to fix the beach umbrella to the beach. In order to facilitate the dissipation of hot inside the umbrella, an umbrella cover of an existing beach umbrella includes an upper layer umbrella cover; a lower layer umbrella cover; and a gap provided between the upper layer umbrella cover and the lower layer umbrella cover. Wind may blow through the gap to achieve the ventilation. However, since each of the above upper layer umbrella cover and the lower layer umbrella cover is an integral umbrella cover, the whole umbrella cover will be subjected to a winding force. The area of the umbrella cover subjected to the winding force is large, thus impacting the stability of the umbrella, and resulting in the umbrella easily blown down by the wind. In addition, since the above beach umbrella has two layers of umbrella covers, the hot inside the umbrella is not easily to be dissipated.

In summary, a technical problem to be solved presently by those skilled in art is to provide an umbrella cover which can improve the stability of the umbrella while achieving the ventilation of the umbrella and can decrease the risk of the umbrella blown down by the wind.

SUMMARY

In view of this, the disclosure is to provide an umbrella cover which can improve the stability of the umbrella while achieving the ventilation of the umbrella, therefore decreasing the risk of the umbrella blown down by the wind.

The disclosure further provides a beach umbrella with the umbrella cover described above.

In order to achieve the object described above, the disclosure provides technical solutions as following.

An umbrella cover includes:

a main umbrella cover provided with a vent; and a shading portion arranged at the vent and adapted to shade sunshine from the vent.

Preferably, the umbrella cover further includes a hollow-out umbrella cloth or a meshed umbrella cloth provided at edges of the vent and connected to the main umbrella cover.

Preferably, in the umbrella cover, the shading portion is located below the vent, an outer end of the shading portion is connected to the main umbrella cover, and a gap is provided between an inner end of the shading portion and a center of the main umbrella cover.

Preferably, in the umbrella cover, the shading portion is arranged along a horizontal direction.

Preferably, in the umbrella cover, the vent is a sector-shaped hole, and the shading portion is a sector-shaped umbrella cover with the same size and shape as the sector-shaped hole.

Preferably, in the umbrella cover, the main umbrella cover is formed by jointing a plurality of first umbrella covers and a plurality of second umbrella covers, each of the first umbrella covers is provided with the vent, and the first umbrella covers and the second umbrella covers are distributed alternately.

Preferably, in the umbrella cover, each of the first umbrella covers and the second umbrella covers is a sector-shaped umbrella cloth.

Preferably, the umbrella cover further includes an outer edge provided on an outer circumferential edge of the main umbrella cover and extended downward.

Based on the technical solutions described above, an umbrella cover provided by the disclosure includes a main umbrella cover and a shading portion. The main umbrella cover is provided with a vent, and the shading portion is arranged at the vent and adapted to shade the sunshine from the vent. When wind blows towards the umbrella cover according to the disclosure, a part of the wind may blow through the vent and take away the hot inside the umbrella, thus achieving the ventilation of the umbrella. In addition, since the main umbrella cover is provided with the vent, the area of the umbrella cover subjected to the winding force is reduced and the winding force subjected by the umbrella cover is reduced further, thus improving the stability of the umbrella and decreasing the risk of the umbrella blown down by the wind. Furthermore, because the umbrella cover according to the disclosure is a one layer umbrella cover constituted by the main umbrella cover and the shading portion, the hot inside the umbrella is easy to be dissipated.

The disclosure further provides a beach umbrella including an umbrella pole and an umbrella cover arranged at a top end of the umbrella pole, the umbrella cover may be any one as described the above. Since the umbrella cover has the above effects, and the beach umbrella with the umbrella cover has the same effects, detailed descriptions for the beach umbrella will be omitted here for simplicity.

BRIEF DESCRIPTION OF THE DRAWINGS

For more clearly illustrating embodiments of the disclosure or the technical solution in the prior art, drawings referred to describe the embodiments or the prior art will be briefly described hereinafter. Apparently, the drawings in the following description are only several embodiments of the disclosure, and for the person skilled in the art other drawings may be obtained based on these drawings without any creative efforts.

DETAILED DESCRIPTION OF EMBODIMENTS

An embodiment of the disclosure provides an umbrella cover which improves the stability of the umbrella while achieving the ventilation of the umbrella, thereby decreasing the risk of the umbrella blown down by the wind.

In order to clarify the objects, the technical solutions and the advantages of the embodiments of the disclosure, the technical solutions in the embodiments of the disclosure will be described clearly and completely hereinafter in conjunction with the drawings in the embodiments of the disclosure. Apparently, the described embodiments are only a part of the embodiments of the disclosure, rather than all embodiments. Based on the embodiments of the disclosure, all of other embodiments, made by the person skilled in the art without any creative efforts, fall into the protection scope of the disclosure.

Figure 1:
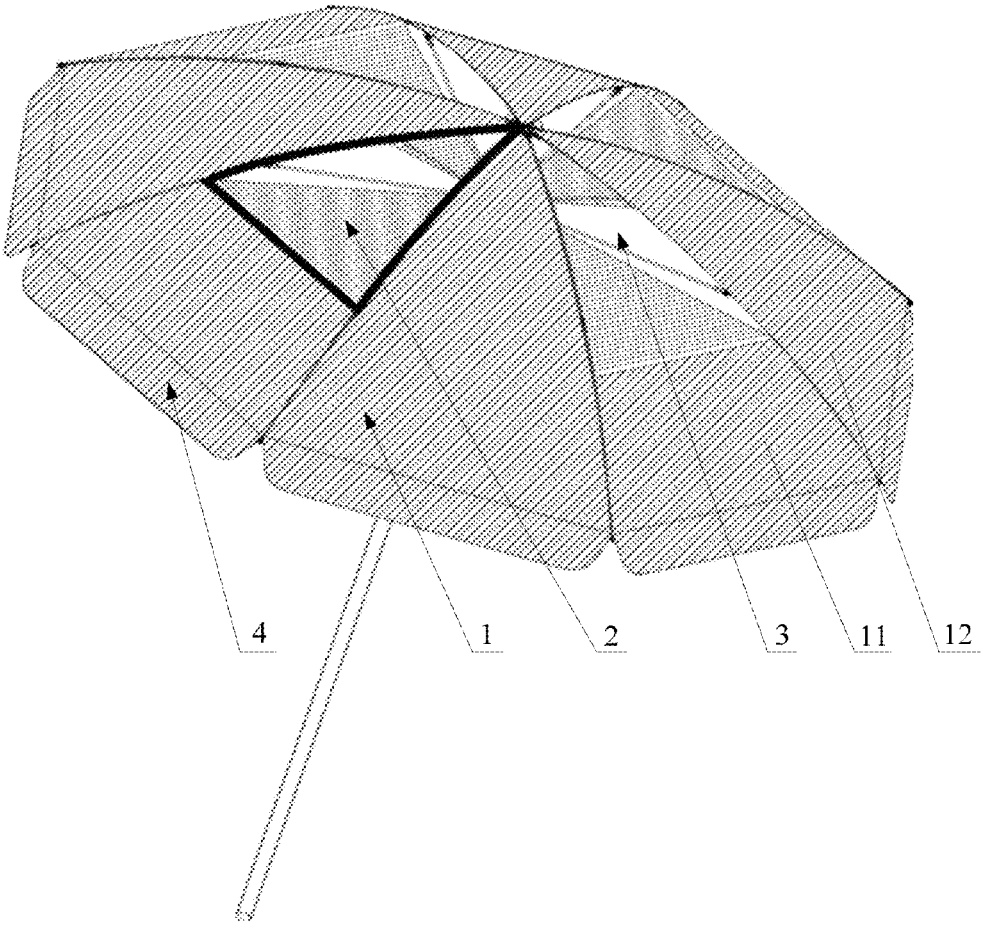
FIG. 1 is a structural schematic view of a beach umbrella with an umbrella cover according to an embodiment of the disclosure.
Figure 2:
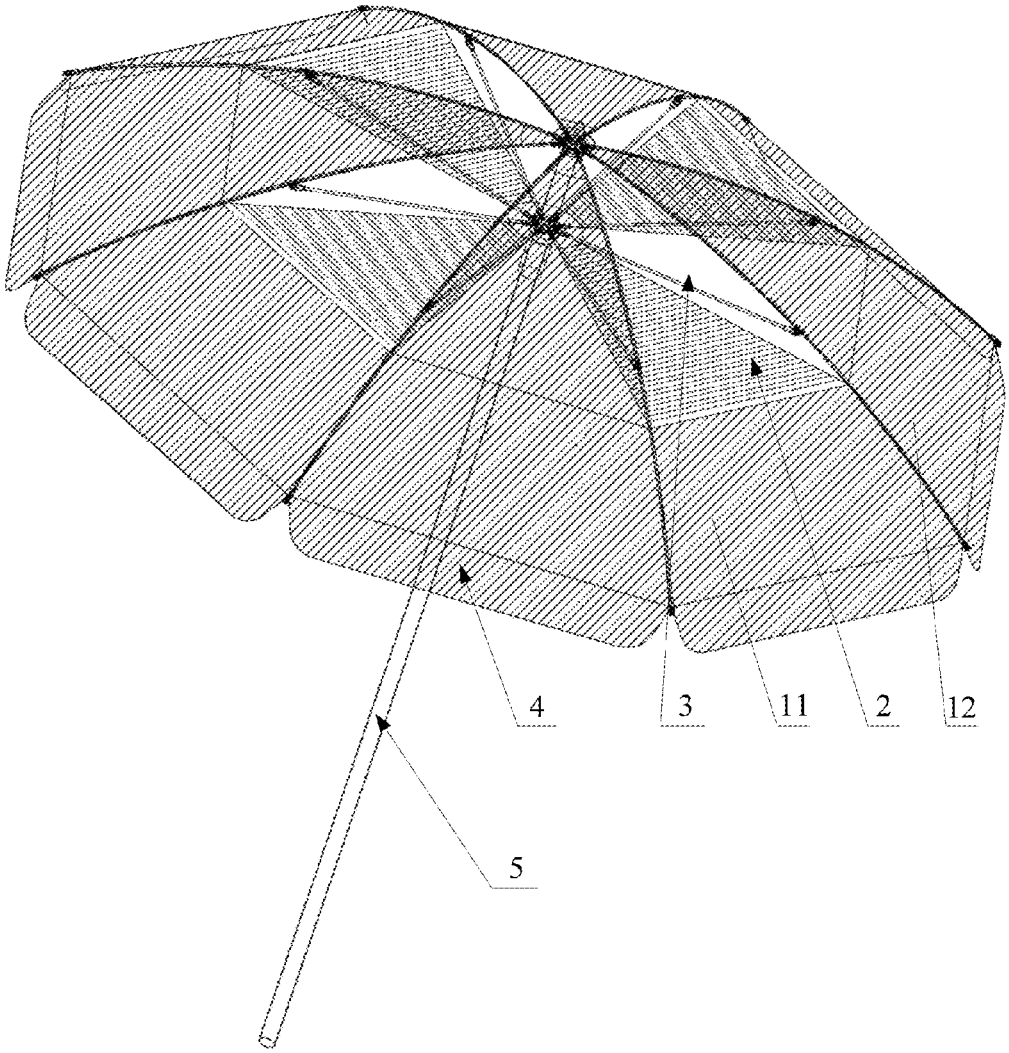
FIG. 2 is a perspective view of a beach umbrella with an umbrella cover according to an embodiment of the disclosure.

Referring to FIGS. 1 and 2, an umbrella cover according to an embodiment of the disclosure includes a main umbrella cover 1 and a shading portion 2. The main umbrella cover 1 is provided with a vent 3. The shading portion 2 is arranged at the vent 3 and adapted to shade sunshine from the vent 3.

When wind blows toward the umbrella cover according to the embodiment, a part of the wind may blow through the vent 3 and take away the hot inside the umbrella, thus achieving the ventilation of the umbrella. In addition, since the main umbrella cover 1 is provided with the vent, the area of the umbrella cover subjected to the winding force is reduced and the winding force subjected by the umbrella cover is reduced further, thus improving the stability of the umbrella, and decreasing the risk of the umbrella blown down by the wind. Furthermore, since the umbrella cover according to the embodiment is a one layer umbrella cover constituted by the main umbrella cover 1 and the shading portions 2, the hot inside the umbrella is easy to be dissipated.

In order to improve sun-shading effect while ensuring the ventilation of the vent 3, the umbrella cover further includes a hollow-out umbrella cloth or a meshed umbrella cloth provided at edges of the vent 3 and connected to the main umbrella cover 1. Namely, thick black lines surrounding the vent 3 in FIG. 1 indicates the edges of the hollow-out umbrella cloth or meshed umbrella cloth. In this way, when wind blows towards the umbrella cover, a part of the wind may blows through small holes or gaps in the hollow-out umbrella cloth or meshed umbrella cloth at the vent 3, thereby implementing the ventilation of the umbrella. Because the hollow umbrella cloth or the meshed umbrella cloth also has a certain sun-shading effect, thereby improving the sun-shading effect of the whole umbrella cover. Apparently, according to the disclosure, the umbrella cloth capable of the ventilation may be not provided at the vent 3, and only the shading portion 2 is provided to implement the shading effect.

The shading portion 2 may be provided above or below the vent 3, in the case that the ventilation of the vent 3 may not be impacted. In the embodiment, the shading portion 2 is preferably located below the vent 3 and an outer end of the shading portion 2 (i.e. the end away from a center of main umbrella cover 1) is connected to the main umbrella cover 1. A gap is provided between an inner end of the shading portion 2 and the center of the main umbrella cover 1. In this way, when wind blows towards the umbrella cover, a part of the wind blows into the umbrella through the vent 3 and blows out through the gap between the inner end of the shading portion 2 and the center of the main umbrella cover 1 by the guiding of the shading portion 2.

In order to facilitate the wind to blow out from the inside of the umbrella, the shading portion 2 is further provided in a horizontal direction. Generally, the wind blows toward the umbrella cover in a horizontal direction. Since the shading portion 2 are provided in horizontal, the part of the wind passing through the vent, when passing by the shading portion, may not be resisted or be slightly resisted in a blowing direction, which facilitates the wind to blow out from the inside of the umbrella and further facilitates the hot inside the umbrella to be dissipated. It may be understood by those skilled in art that the shading portion 2 may also be provided in other directions, such as provided in a curvature different from that of the main umbrella cover 1 or arranged at an inclination angle with respect to the horizontal direction. Thus, the effect of shading the sunshine at the vent 3 may also be implemented and the winding may pass through the gap between the shading portion 2 and the main umbrella cover 1, which will no be introduced one by one.

The vent 3 may be a circular-shaped hole, a rectangular-shaped hole or other irregular holes. According to the embodiment, the vent 3 of the umbrella cover is preferred to be a sector-shaped hole, and the shading portion 2 is a sector-shaped umbrella cover with the same size, shape as the sector-shaped hole. In this way, the vent 3 is formed by removing a part of umbrella cloth from one layer integral umbrella cloth, and the removed part of umbrella cloth is used to the shading portion 2, thus facilitating the production of the umbrella cover and also reducing the cost of umbrella cloth. Alternatively, in order to improve the sun-shading effect, the area of the shading portion 2 may have an area lager than the vent 3 to shade the sunshine in different directions.

As shown in FIGS. 1 and 2, the main umbrella cover 1 is formed by jointing multiple first umbrella covers 11 and multiple second umbrella covers 12. Each of the first umbrella covers 11 is provided with the vent 3. The first umbrella covers 11 and the second umbrella covers 12 are distributed alternately. In this way, the first umbrella covers 11 and the second umbrella covers 12 are arranged alternately in a circumferential direction of the umbrella pole 5. The vents 3 are evenly arranged in a circumferential direction of the umbrella cover. In this way, the area of the main umbrella cover 1 subjected to the force in a circumferential direction is evenly arranged. In addition, both a leeward side and a windward side of the main umbrella cover 1 are provided with the vents 3, which facilitates the wind to blow out from the inside of the umbrella, and thus improving the ventilation and heat dissipation.

Further, each of the first umbrella covers 11 and the second umbrella covers 12 is a sector-shaped umbrella cloth; which facilitates the manufacture of the umbrella. Alternatively, the first umbrella cover 11 and the second umbrella cover 12 may also be in other shapes such as a trapezoid-shaped umbrella cloth or a polygonal-shaped umbrella cloth, as long as they may be split jointed as an umbrella cover with a sun-shading function.

For further optimizing the above technical solutions, the umbrella cover further includes an outer edge 4 arranged on a circumferential edge of the main umbrella cover 1 and extended downward. The outer edge 4 can shade the sunshine, and thus improving the sun-shading effect of the umbrella cover.

An embodiment of the disclosure further provides a beach umbrella which includes an umbrella pole 5 and an umbrella cover provided on a top end of the umbrella pole 5. The umbrella cover is any one as described according the embodiments of the disclosure.

The above beach umbrella employs the umbrella cover according to an embodiment of the disclosure, thus improving the stability of the umbrella while achieving the ventilation of the umbrella, and thereby decreasing the risk of the umbrella blown down by the wind. The advantages of the beach umbrella owes to the umbrella cover, references may be made to the related parts of the embodiments described above for the detail, thus detailed description will be omitted here for simplicity The above embodiments are described in a progressive manner. Each of the embodiments is mainly focused on describing its differences from other embodiments, and references may be made among these embodiments with respect to the same or similar portions among these embodiments.

Based on the above description of the disclosed embodiments, the person skilled in the art is capable of carrying out or using the disclosure. It is obvious for the person skilled in the art to make many modifications to these embodiments. The general principle defined herein may be applied to other embodiments without departing from the spirit or scope of the disclosure. Therefore, the disclosure is not limited to the embodiments illustrated herein, but should be defined by the broadest scope consistent with the principle and novel features disclosed herein.

The invention claimed is:

1. An umbrella cover, comprising:

a main umbrella cover provided with a plurality of vents; and a shading portion arranged at each of the pluarlity of vents and adapted to shade sunshine from the vent;

wherein the main umbrella cover is formed by jointing a plurality of first umbrella covers and a plurality of second umbrella covers, each of the first umbrella covers is provided with one of the pluarlity of vents, and the first umbrella covers and the second umbrella covers are distributed alternately, wherein the shading portion is located below the vent, an outer end of the shading portion is connected to the main umbrella cover, and a gap is formed between an inner end of the shading portion and a center of the main umbrella cover.

2. The umbrella cover according to claim 1, further comprising a hollow-out umbrella cloth or a meshed umbrella cloth provided at edges of the vent and connected to the main umbrella cover.

3. The umbrella cover according to claim 1, wherein the shading portion is arranged along a horizontal direction.

4. The umbrella cover according to claim 1, wherein the vent is a sector-shaped hole, and the shading portion is a sector-shaped umbrella cover with the same size and shape as the sector-shaped hole.

5. The umbrella cover according to claim 1, wherein each of the first umbrella covers and the second umbrella covers is a sector-shaped umbrella cloth.

6. The umbrella cover according to claim 1, further comprising an outer edge provided on an outer circumferential edge of the main umbrella cover and extended downward.

7. A beach umbrella, comprising an umbrella pole and an umbrella cover arranged at a top end of the umbrella pole, wherein the umbrella cover comprising:

a main umbrella cover provided with a plurality of vents; and a shading portion arranged at each of the plurality of vents and adapted to shade sunshine from the vent;

wherein the main umbrella cover is formed by jointing a plurality of first umbrella covers and a plurality of second umbrella covers, each of the first umbrella covers is provided with one of the plurality of vents, and the first umbrella covers and the second umbrella covers are distributed alternately, wherein the shading portion is located below the vent, an outer end of the shading portion is connected to the main umbrella cover, and a gap is formed between an inner end of the shading portion and a center of the main umbrella cover.

8. The beach umbrella according to claim 7, further comprising a hollow-out umbrella cloth or a meshed umbrella cloth provided at edges of the vent and connected to the main umbrella cover.

9. The beach umbrella according to claim 7, wherein the shading portion is arranged along a horizontal direction.

10. The beach umbrella according to claim 7, wherein the vent is a sector-shaped hole, and the shading portion is a sector-shaped umbrella cover with the same size and shape as the sector-shaped hole.

11. The beach umbrella according to claim 7, wherein each of the first umbrella covers and the second umbrella covers is a sector-shaped umbrella cloth.

12. The beach umbrella according to claim 7, further comprising an outer edge provided on an outer circumferential edge of the main umbrella cover and extended downward.

* * * * *